US008737854B2

(12) United States Patent
Zaretsky

(10) Patent No.: US 8,737,854 B2
(45) Date of Patent: May 27, 2014

(54) PRINTING SYSTEM WITH RECEIVER CAPACITANCE ESTIMATION

(75) Inventor: Mark Cameron Zaretsky, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 231 days.

(21) Appl. No.: 13/430,800

(22) Filed: Mar. 27, 2012

(65) Prior Publication Data

US 2013/0259505 A1 Oct. 3, 2013

(51) Int. Cl.
*G03G 15/00* (2006.01)
*G03G 15/16* (2006.01)

(52) U.S. Cl.
USPC ..... 399/45; 399/66

(58) Field of Classification Search
USPC ..... 399/44, 45, 66, 303, 312, 314, 389; 324/664, 689
See application file for complete search history.

(56) References Cited

U.S. PATENT DOCUMENTS 4,610,530 A * 9/1986 Lehmbeck et al. ..... 399/69
5,291,253 A * 3/1994 Kumasaka et al. ..... 399/66
5,572,309 A * 11/1996 Nishio et al. ..... 399/389
6,223,004 B1 * 4/2001 Kodama ..... 399/44
6,253,041 B1 * 6/2001 Tomizawa et al. ..... 399/66
6,477,339 B1 11/2002 Yano et al.
6,493,523 B2 * 12/2002 Weaver ..... 399/45
6,771,913 B2 * 8/2004 Jeschonek et al. ..... 399/49
7,855,565 B2 * 12/2010 Liu et al. ..... 324/663

FOREIGN PATENT DOCUMENTS

JP 06161307 A * 6/1994

* cited by examiner

*Primary Examiner* — Robert Beatty
(74) *Attorney, Agent, or Firm* — Christopher J. White

(57) ABSTRACT

A printing system includes a rotatable transport member that transports a receiver on its obverse. A tackdown unit includes an electrode arranged facing the reverse of the transport member. A source responsive to the control system produces a tackdown current, and a charger spaced apart from the transport member facing the obverse thereof selectively deposits charge on the receiver in response to the tackdown current. A non-contact voltmeter arranged facing the receiver on the obverse after the charger measures a resulting voltage. A control system drives a selected voltage or current through the charger using the source and measures a resulting voltage using the non-contact voltmeter. The selected voltage or current and the measured resulting voltage are used to automatically estimate a capacitance of the receiver.

14 Claims, 3 Drawing Sheets

PRINTING SYSTEM WITH RECEIVER CAPACITANCE ESTIMATION

CROSS-REFERENCE TO RELATED APPLICATIONS

Reference is made to commonly assigned, U.S. patent application Ser. No. 13/305,805, filed Nov. 29, 2011, entitled "TRANSFER UNIT WITH COMPENSATION FOR VARIATION," by Zaretsky; and U.S. patent application Ser. No. 13/406,557, filed Feb. 28, 2012, entitled "TRANSFER UNIT WITH COMPENSATION FOR VARIATION," by Zaretsky; the disclosures of which are incorporated by reference herein.

FIELD OF THE INVENTION

This invention pertains to the field of electrophotographic printing and more particularly to compensating for variations.

BACKGROUND OF THE INVENTION

Electrophotography is a useful process for printing images on a receiver (or "imaging substrate"), such as a piece or sheet of paper or another planar medium, glass, fabric, metal, or other objects as will be described below. In this process, an electrostatic latent image is formed on a photoreceptor by uniformly charging the photoreceptor and then discharging selected areas of the uniform charge to yield an electrostatic charge pattern corresponding to the desired image (a "latent image").

After the latent image is formed, charged toner particles are brought into the vicinity of the photoreceptor and are attracted to the latent image to develop the latent image into a visible image. Note that the visible image may not be visible to the naked eye depending on the composition of the toner particles (e.g. clear toner).

After the latent image is developed into a visible image on the photoreceptor, a suitable receiver is brought into juxtaposition with the visible image. A suitable electric field is applied to transfer the toner particles of the visible image to the receiver to form the desired print image on the receiver. The imaging process is typically repeated many times with reusable photoreceptors.

The magnitude of electric field to be applied to transfer an appropriate amount of toner depends on a variety of factors. For example, it is known to adjust transfer bias based on which side of the receiver is being printed, the width of the receiver, or environmental factors such as the temperature. One such factor is resistance of a transfer belt. U.S. Pat. No. 6,477,339 describes measuring the resistance of a transfer belt by applying a constant current and measuring the voltage required to sustain that current. However, this method requires mechanical contact with the transfer belt. Contaminants on receivers can transfer to the belt or roller, or vice-versa. Other types of contact current measurements can be done and have the same drawbacks. Non-contact AC measurements have also been attempted, but such measurements require maintaining a tight tolerance on the air gap between the measurement electrodes and the surface of the receiver. This is difficult, and can require adjustment of the electrode position every time the receiver thickness changes, increasing the time required to set up a job and decreasing printer productivity.

Another factor that affects transfer performance is receiver capacitance. This changes with each receiver due to mechanical variations in the shape and thickness of the receiver, and can change with environmental conditions (e.g., as the moisture content of a paper receiver changes). Various schemes have been tried, including on-line mechanical measurements of actual paper thickness and AC bridge measurements for measuring the dielectric properties of the receiver. However, mechanical measurements or any contact measurements subject the measurement equipment to wear and possible damage. Contact measurements also limit the types and sizes of receiver that can be used. Moreover, mechanical thickness measurements cannot determine moisture content of a receiver or the corresponding electrical thickness.

There is a continuing need, therefore, for an improved printing system that measures receiver capacitance and optionally adjusts transfer characteristics based on that measurement.

SUMMARY OF THE INVENTION

According to an aspect of the present invention, there is provided a printing system, comprising:

a) a rotatable transport member having an obverse and a reverse and adapted to transport a receiver on its obverse;

b) a tackdown unit that includes:

i) an electrode arranged facing the reverse of the transport member;

ii) a source for selectively producing a tackdown current;

iii) a charger spaced apart from the transport member facing the obverse thereof, the charger adapted to selectively deposit charge on a receiver on the obverse in response to the tackdown current; and iv) a non-contact voltmeter arranged facing the receiver on the obverse after the charger; and c) a control system adapted to:

i) drive a selected voltage or current through the charger using the source and measure a resulting voltage using the non-contact voltmeter; and ii) using the selected voltage or current and the measured resulting voltage, automatically estimate a capacitance of the receiver.

An advantage of a printing system according to this invention is that it measures receiver capacitance (and electrical thickness) in a non-contact way that does not constrain the types of substrates that can be used. Since measurements are non-contact, the measurement subsystem is not subject to wear or damage due to receiver contact. Various embodiments do not require calibration of, or tracking the properties of, mechanical components used to make electrical measurements. In various embodiments, these measurements permit selecting an appropriate transfer bias, thereby improving image quality and increasing robustness to variations in factors that can alter electrical properties (e.g., temperature, relative humidity, and manufacturing tolerances). In various embodiments, the voltmeter is sufficiently accurate over a range of spacings to measure various thicknesses of receiver without requiring mechanical repositioning.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

Figure 1:
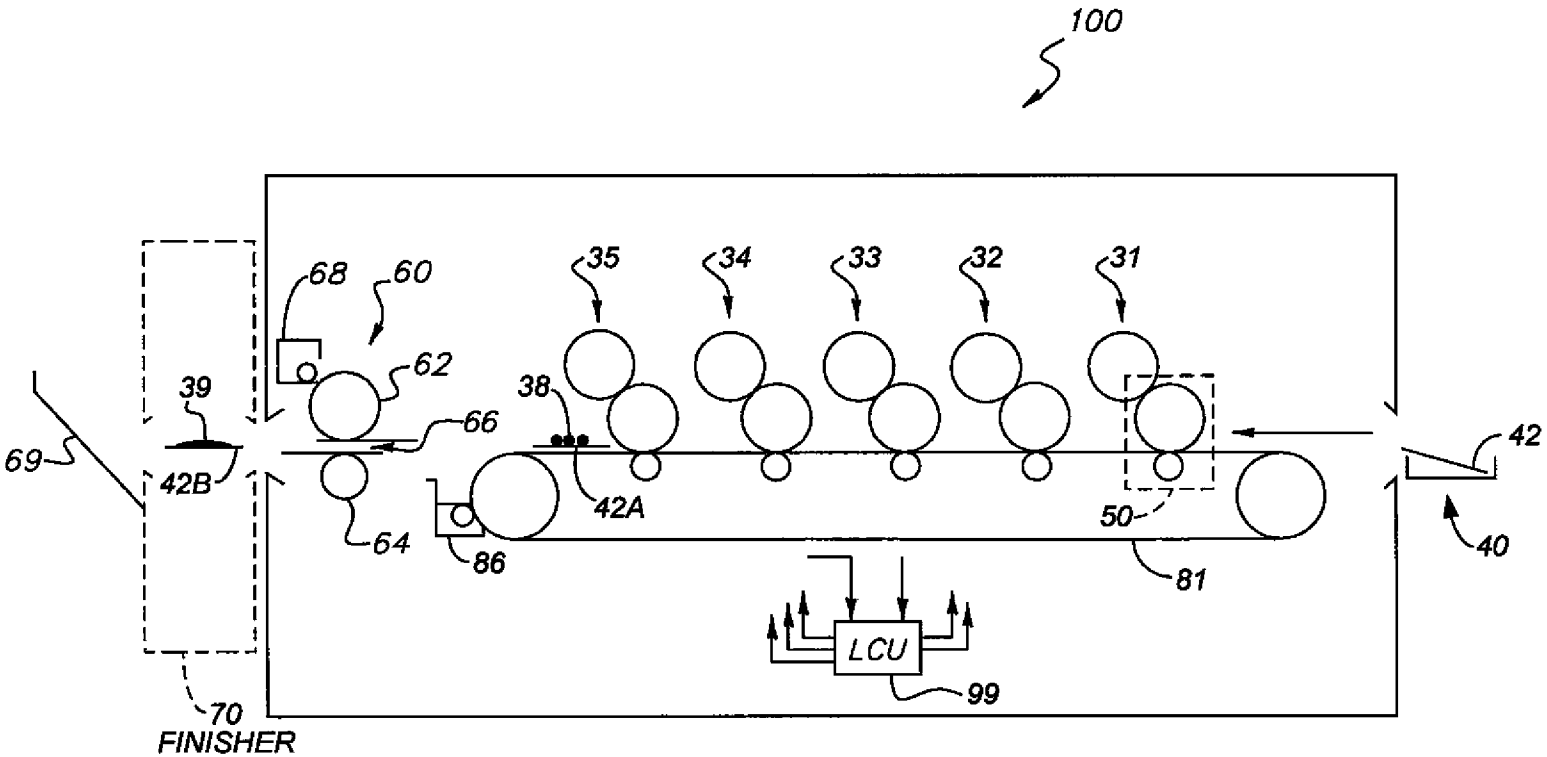
FIG. 1 is an elevational cross-section of an electrophotographic reproduction apparatus according to an embodiment.

The attached drawings are for purposes of illustration and are not necessarily to scale.

DETAILED DESCRIPTION OF THE INVENTION

In the following description, some embodiments will be described in terms that would ordinarily be implemented as software programs. Those skilled in the art will readily recognize that the equivalent of such software can also be constructed in hardware. Because data-manipulation algorithms and systems are well known, the present description will be directed in particular to algorithms and systems forming part of, or cooperating more directly with, methods described herein. Other aspects of such algorithms and systems, and hardware or software for producing and otherwise processing data signals involved therewith, not specifically shown or described herein, are selected from such systems, algorithms, components, and elements known in the art. Given the system as described herein, software not specifically shown, suggested, or described herein that is useful for implementation of various embodiments is conventional and within the ordinary skill in such arts.

A computer program product can include one or more storage media, for example; magnetic storage media such as magnetic disk (such as a floppy disk) or magnetic tape; optical storage media such as optical disk, optical tape, or machine readable bar code; solid-state electronic storage devices such as random access memory (RAM), or read-only memory (ROM); or any other physical device or media employed to store a computer program having instructions for controlling one or more computers to practice methods according to various embodiments.

The electrophotographic (EP) printing process can be embodied in devices including printers, copiers, scanners, and facsimiles, and analog or digital devices, all of which are referred to herein as "printers." Electrostatographic printers such as electrophotographic printers that employ toner developed on an electrophotographic receiver can be used, as can ionographic printers and copiers that do not rely upon an electrophotographic receiver. Electrophotography and ionography are types of electrostatography (printing using electrostatic fields), which is a subset of electrography (printing using electric fields).

In the electrophotographic process, after toner is transferred to the receiver, as described above, the receiver is removed from its operative association with the photoreceptor and subjected to heat or pressure to permanently fix ("fuse") the print image to the receiver. Plural print images, e.g. of separations of different colors, are overlaid on one receiver before fusing to form a multi-color print image on the receiver.

Electrophotographic (EP) printers typically transport the receiver past the photoreceptor to form the print image. The direction of travel of the receiver is referred to as the slow-scan, process, or in-track direction. This is typically the vertical (Y) direction of a portrait-oriented receiver. The direction perpendicular to the slow-scan direction is referred to as the fast-scan, cross-process, or cross-track direction, and is typically the horizontal (X) direction of a portrait-oriented receiver. "Scan" does not imply that any components are moving or scanning across the receiver; the terminology is conventional in the art.

A digital reproduction printing system ("printer") typically includes a digital front-end processor (DFE), a print engine (also referred to in the art as a "marking engine") for applying toner to the receiver, and one or more post-printing finishing system(s) (e.g. a UV coating system, a glosser system, or a laminator system). A printer can reproduce pleasing black-and-white or color onto a receiver. A printer can also produce selected patterns of toner on a receiver, which patterns (e.g. surface textures) do not correspond directly to a visible image. The DFE receives input electronic files (such as Postscript command files) composed of images from other input devices (e.g., a scanner, a digital camera). The DFE can include various function processors, e.g. a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, media type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g. the electrophotographic process) to provide known, consistent color reproduction characteristics. The color management system can also provide known color reproduction for different inputs (e.g. digital camera images or film images).

In an embodiment of an electrophotographic modular printing machine, e.g. the NEXPRESS 3000SE printer manufactured by Eastman Kodak Company of Rochester, N.Y., color-toner print images are made in a plurality of color imaging modules arranged in tandem, and the print images are successively electrostatically transferred to a receiver adhered to a transport web moving through the modules. Colored toners include colorants, e.g. dyes or pigments, which absorb specific wavelengths of visible light. Commercial machines of this type typically employ intermediate transfer members in the respective modules for transferring visible images from the photoreceptor and transferring print images to the receiver. In other electrophotographic printers, each visible image is directly transferred to a receiver to form the corresponding print image.

Electrophotographic printers having the capability to also deposit clear toner using an additional imaging module are also known. As used herein, clear toner is considered to be a color of toner, as are C, M, Y, K, and Lk, but the term "colored toner" excludes clear toners. The provision of a clear-toner overcoat to a color print is desirable for providing protection of the print from fingerprints and reducing certain visual artifacts. Clear toner uses particles that are similar to the toner particles of the color development stations but without colored material (e.g. dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective toners are deposited one upon the other at respective locations on the receiver and the height of a respective toner stack is the sum of the toner heights of each respective color. Uniform stack height provides the print with a more even or uniform gloss.

Figure 2:
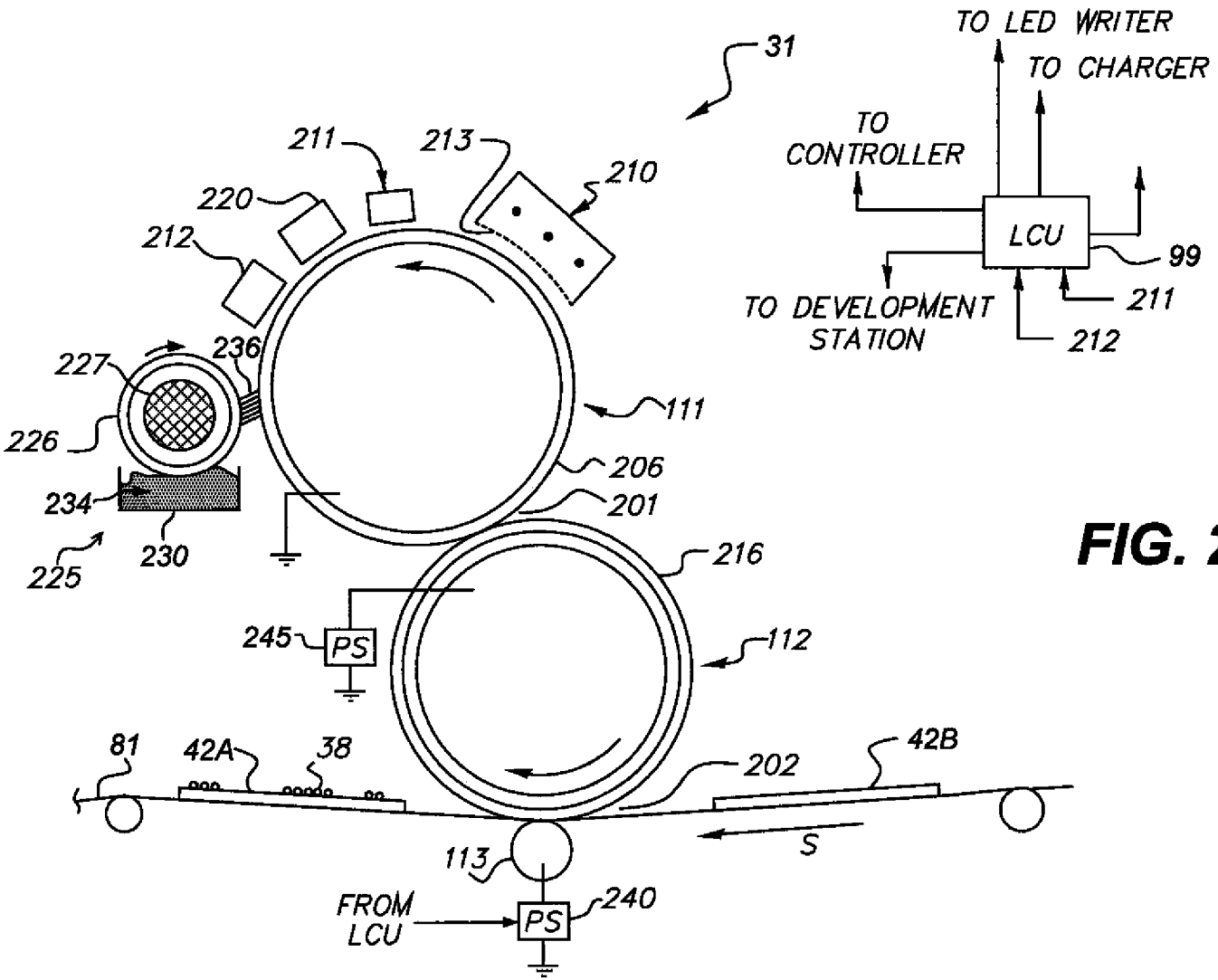
FIG. 2 is an elevational cross-section of the reprographic image-producing portion of the apparatus of FIG. 1.

FIGS. 1 and 2 are elevational cross-sections showing portions of a typical electrophotographic printer 100. Printer 100 is adapted to produce print images, such as single-color (monochrome), CMYK, or pentachrome (five-color) images, on a receiver (multicolor images are also known as "multicomponent" images). Images can include text, graphics, photos, and other types of visual content. An embodiment involves printing using an electrophotographic print engine having five sets of single-color image-producing or -printing stations or modules arranged in tandem, but more or less than five colors can be combined to form a print image on a given receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, also known as electrophotographic imaging subsystems. Each printing module 31, 32, 33, 34, 35 produces a single-color toner image for transfer using a respective transfer subsystem 50 (for clarity, only one is labeled) to a receiver 42 successively moved through the modules. Receiver 42 is transported from supply unit 40, which can include active feeding subsystems as known in the art, into printer 100. In various embodiments, the visible image can be transferred directly from an imaging roller to a receiver 42, or from an imaging roller to one or more transfer roller(s) or belt(s) in sequence in transfer subsystem 50, and thence to receiver 42. Receiver 42 is, for example, a selected section of a web of, or a cut sheet of, planar media such as paper or transparency film.

Each receiver 42, during a single pass through the five printing modules 31, 32, 33, 34, 35, can have transferred in registration thereto up to five single-color toner images to form a pentachrome image. As used herein, the term "pentachrome" implies that in a print image, combinations of various of the five colors are combined to form other colors on receiver 42 at various locations on receiver 42. That is, each of the five colors of toner can be combined with toner of one or more of the other colors at a particular location on receiver 42 to form a color different than the colors of the toners combined at that location. In an embodiment, printing module 31 forms black (K) print images, 32 forms yellow (Y) print images, 33 forms magenta (M) print images, 34 forms cyan (C) print images, and 35 forms clear-toner images.

Printing module 35 can form a red, blue, green, or other fifth print image, including an image formed from a clear toner (i.e. one lacking pigment). The four subtractive primary colors, cyan, magenta, yellow, and black, can be combined in various combinations of subsets thereof to form a representative spectrum of colors. The color gamut or range of a printer is dependent upon the materials used and process used for forming the colors. The fifth color can therefore be added to improve the color gamut. In addition to adding to the color gamut, the fifth color can also be a specialty color toner or spot color, such as for making proprietary logos or colors that cannot be produced with only CMYK colors (e.g. metallic, fluorescent, or pearlescent colors), or a clear toner or tinted toner. Tinted toners absorb less light than they transmit, but do contain pigments or dyes that move the hue of light passing through them towards the hue of the tint. For example, a blue-tinted toner coated on white paper will cause the white paper to appear light blue when viewed under white light, and will cause yellows printed under the blue-tinted toner to appear slightly greenish under white light.

Receiver 42A is shown after passing through printing module 35. Print image 38 on receiver 42A includes unfused toner particles.

Subsequent to transfer of the respective print images 38, overlaid in registration, one from each of the respective printing modules 31, 32, 33, 34, 35, receiver 42A is advanced to a fuser 60, i.e. a fusing or fixing assembly, to fuse print image 38 to receiver 42A. Transport web 81 transports the print-image-carrying receivers (e.g., 42A) to fuser 60, which fixes the toner particles to the respective receivers 42A by the application of heat and pressure. The receivers 42A are serially de-tacked from transport web 81 to permit them to feed cleanly into fuser 60. Transport web 81 is then reconditioned for reuse at cleaning station 86 by cleaning and neutralizing the charges on the opposed surfaces of the transport web 81. A mechanical cleaning station (not shown) for scraping or vacuuming toner off transport web 81 can also be used independently or with cleaning station 86. The mechanical cleaning station can be disposed along transport web 81 before or after cleaning station 86 in the direction of rotation of transport web 81.

Fuser 60 includes a heated fusing roller 62 and an opposing pressure roller 64 that form a fusing nip 66 therebetween. In an embodiment, fuser 60 also includes a release fluid application substation 68 that applies release fluid, e.g. silicone oil, to fusing roller 62. Alternatively, wax-containing toner can be used without applying release fluid to fusing roller 62. Other embodiments of fusers, both contact and non-contact, can be employed. For example, solvent fixing uses solvents to soften the toner particles so they bond with the receiver 42. Photoflash fusing uses short bursts of high-frequency electromagnetic radiation (e.g. ultraviolet light) to melt the toner. Radiant fixing uses lower-frequency electromagnetic radiation (e.g. infrared light) to more slowly melt the toner. Microwave fixing uses electromagnetic radiation in the microwave range to heat the receivers (primarily), thereby causing the toner particles to melt by heat conduction, so that the toner is fixed to the receiver 42.

The receivers (e.g., receiver 42B) carrying the fused image (e.g., fused image 39) are transported in a series from the fuser 60 along a path either to a remote output tray 69, or back to printing modules 31, 32, 33, 34, 35 to create an image on the backside of the receiver (e.g., receiver 42B), i.e. to form a duplex print. Receivers (e.g., receiver 42B) can also be transported to any suitable output accessory. For example, an auxiliary fuser or glossing assembly can provide a clear-toner overcoat. Printer 100 can also include multiple fusers 60 to support applications such as overprinting, as known in the art.

In various embodiments, between fuser 60 and output tray 69, receiver 42B passes through finisher 70. Finisher 70 performs various media-handling operations, such as folding, stapling, saddle-stitching, collating, and binding.

Printer 100 includes main printer apparatus logic and control unit (LCU) 99, which receives input signals from the various sensors associated with printer 100 and sends control signals to the components of printer 100. LCU 99 can include a microprocessor incorporating suitable look-up tables and control software executable by the LCU 99. It can also include a field-programmable gate array (FPGA), programmable logic device (PLD), microcontroller, or other digital control system. LCU 99 can include memory for storing control software and data. Sensors associated with the fusing assembly provide appropriate signals to the LCU 99. In response to the sensors, the LCU 99 issues command and control signals that adjust the heat or pressure within fusing nip 66 and other operating parameters of fuser 60 for receivers. This permits printer 100 to print on receivers of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of respective LED writers, e.g. for black (K), yellow (Y), magenta (M), cyan (C), and red (R), respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes, e.g. color correction, in order to obtain the desired color print. Color image data is separated into the respective colors and converted by the RIP to halftone dot image data in the respective color using matrices, which comprise desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Further details regarding printer 100 are provided in U.S. Pat. No. 6,608,641, issued on Aug. 19, 2003, to Peter S. Alexandrovich et al., and in U.S. Publication No. 2006/0133870, published on Jun. 22, 2006, by Yee S. Ng et al., the disclosures of which are incorporated herein by reference.

FIG. 2 shows more details of printing module 31, which is representative of printing modules 32, 33, 34, and 35 (FIG. 1). Primary charging subsystem 210 uniformly electrostatically charges photoreceptor 206 of imaging member 111, shown in the form of an imaging cylinder. Charging subsystem 210 includes a grid 213 having a selected voltage. Additional components provided for control can be assembled about the various process elements of the respective printing modules. Meter 211 measures the uniform electrostatic charge provided by charging subsystem 210, and meter 212 measures the post-exposure surface potential within a patch area of a latent image formed from time to time in a non-image area on photoreceptor 206. Other meters and components can be included.

LCU 99 sends control signals to the charging subsystem 210, the exposure subsystem 220 (e.g., laser or LED writers), and the respective development station 225 of each printing module 31, 32, 33, 34, 35 (FIG. 1), among other components. Each printing module can also have its own respective controller (not shown) coupled to LCU 99.

Imaging member 111 includes photoreceptor 206. Photoreceptor 206 includes a photoconductive layer formed on an electrically conductive substrate. The photoconductive layer is an insulator in the substantial absence of light so that electric charges are retained on its surface. Upon exposure to light, the charge is dissipated. In various embodiments, photoreceptor 206 is part of, or disposed over, the surface of imaging member 111, which can be a plate, drum, or belt. Photoreceptors can include a homogeneous layer of a single material such as vitreous selenium or a composite layer containing a photoconductor and another material. Photoreceptors can also contain multiple layers.

An exposure subsystem 220 is provided for image-wise modulating the uniform electrostatic charge on photoreceptor 206 by exposing photoreceptor 206 to electromagnetic radiation to form a latent electrostatic image (e.g., of a separation corresponding to the color of toner deposited at this printing module). The uniformly-charged photoreceptor 206 is typically exposed to actinic radiation provided by selectively activating particular light sources in an LED array or a laser device outputting light directed at photoreceptor 206. In embodiments using laser devices, a rotating polygon (not shown) is used to scan one or more laser beam(s) across the photoreceptor in the fast-scan direction. One dot site is exposed at a time, and the intensity or duty cycle of the laser beam is varied at each dot site. In embodiments using an LED array, the array can include a plurality of LEDs arranged next to each other in a line, some or all dot sites in one row of dot sites on the photoreceptor can be selectively exposed simultaneously, and the intensity or duty cycle of each LED can be varied within a line exposure time to expose each dot site in the row during that line exposure time.

As used herein, an "engine pixel" is the smallest addressable unit on photoreceptor 206 or receiver 42 (FIG. 1) which the light source (e.g., laser or LED) can expose with a selected exposure different from the exposure of another engine pixel. Engine pixels can overlap, e.g., to increase addressability in the slow-scan direction (S). Each engine pixel has a corresponding engine pixel location, and the exposure applied to the engine pixel location is described by an engine pixel level.

The exposure subsystem 220 can be a write-white or write-black system. In a write-white or charged-area-development (CAD) system, the exposure dissipates charge on areas of photoreceptor 206 to which toner should not adhere. Toner particles are charged to be attracted to the charge remaining on photoreceptor 206. The exposed areas therefore correspond to white areas of a printed page. In a write-black or discharged-area development (DAD) system, the toner is charged to be attracted to a bias voltage applied to photoreceptor 206 and repelled from the charge on photoreceptor 206. Therefore, toner adheres to areas where the charge on photoreceptor 206 has been dissipated by exposure. The exposed areas therefore correspond to black areas of a printed page.

A development station 225 includes toning shell 226, which can be rotating or stationary, for applying toner of a selected color to the latent image on photoreceptor 206 to produce a visible image on photoreceptor 206. Development station 225 is electrically biased by a suitable respective voltage to develop the respective latent image, which voltage can be supplied by a power source (not shown). Developer is provided to toning shell 226 by a supply system (not shown), e.g., a supply roller, auger, or belt. Toner is transferred by electrostatic forces from development station 225 to photoreceptor 206. These forces can include Coulombic forces between charged toner particles and the charged electrostatic latent image, and Lorentz forces on the charged toner particles due to the electric field produced by the bias voltages.

In an embodiment, development station 225 employs a two-component developer that includes toner particles and magnetic carrier particles. Development station 225 includes a magnetic core 227 to cause the magnetic carrier particles near toning shell 226 to form a "magnetic brush," as known in the electrophotographic art. Magnetic core 227 can be stationary or rotating, and can rotate with a speed and direction the same as or different than the speed and direction of toning shell 226. Magnetic core 227 can be cylindrical or non-cylindrical, and can include a single magnet or a plurality of magnets or magnetic poles disposed around the circumference of magnetic core 227. Alternatively, magnetic core 227 can include an array of solenoids driven to provide a magnetic field of alternating direction. Magnetic core 227 preferably provides a magnetic field of varying magnitude and direction around the outer circumference of toning shell 226. Further details of magnetic core 227 can be found in U.S. Pat. No. 7,120,379 to Eck et al., issued Oct. 10, 2006, and in U.S. Publication No. 2002/0168200 to Stelter et al., published Nov. 14, 2002, the disclosures of which are incorporated herein by reference. Development station 225 can also employ a mono-component developer comprising toner, either magnetic or non-magnetic, without separate magnetic carrier particles.

As used herein, the term "development member" refers to the member(s) or subsystem(s) that provide toner to photoreceptor 206. In an embodiment, toning shell 226 is a development member. In another embodiment, toning shell 226 and magnetic core 227 together compose a development member.

Transfer subsystem 50 (FIG. 1) includes transfer backup member 113, and intermediate transfer member 112 for transferring the respective print image from photoreceptor 206 of imaging member 111 through a first transfer nip 201 to surface 216 of intermediate transfer member 112, and thence to a receiver (e.g., 42B) which receives the respective toned print images 38 from each printing module in superposition to form a composite image thereon. Print image 38 is e.g., a separation of one color, such as cyan. Receivers are transported by transport web 81. Print images are transferred from photoreceptor 206 to intermediate transfer member 112 by an electrical field provided between imaging member 111 and intermediate transfer member 112. In various embodiments, a conductive core of imaging member 111 is grounded and a core of intermediate transfer member 112 is connected to power source 245 (controlled by LCU 99), which applies a bias to the core of intermediate transfer member 112. In other embodiments, both cores are biased, or only that of the imaging member, or both cores are biased to different voltages. Print images are transferred from intermediate transfer member 112 to receiver 42B by an electrical field established by biasing transfer backup member 113 with power source 240, which is controlled by LCU 99. In various embodiments, during transfer to receiver 42B, power source 245 biases the core of intermediate transfer member 112 to a constant voltage. In various embodiments, the same bias from power source 245 is used for transfer from photoreceptor 206 to intermediate transfer member 112 and from intermediate transfer member 112 to receiver 42B. Receivers can be any objects or surfaces onto which toner can be transferred from imaging member 111 by application of the electric field. In this example, receiver 42B is shown prior to entry into second transfer nip 202, and receiver 42A is shown subsequent to transfer of the print image 38 onto receiver 42A.

Still referring to FIG. 2, toner is transferred from toning shell 226 to photoreceptor 206 in toning zone 236. As described above, toner is selectively supplied to the photoreceptor by toning shell 226. Toning shell 226 receives developer 234 from developer supply 230, which can include a mixer. Developer 234 includes toner particles and carrier particles.

In various embodiments, a corona charger operating in a constant media current mode (regulation of the difference between the wire current and the return current through the shell and guide) delivers a known quantity of charge to tack down a receiver on a moving, insulating transport web. A non-contacting electrostatic voltmeter located downstream of the device is used to measure the surface potential of the tacked down receiver. Given the knowledge of the surface charge density deposited, the measured receiver surface potential, and the capacitance of the transport web, an estimation of the receiver capacitance is made. This estimation can be used to adjust the transfer bias required for toner transfer. The measured capacitance is the series capacitance of the receiver and the transport member (e.g., web) carrying the receiver. The capacitance of the web can be determined and stored, then used with the measurement to determine the capacitance of the receiver. The transfer bias is adjusted based on detected receiver properties. In addition to the adjustments described herein, transfer bias can be adjusted based on which side of the receiver is being printed, or on temperature, environment, or paper width, and any of these adjustments can be used in combination with those disclosed herein.

Figure 3:
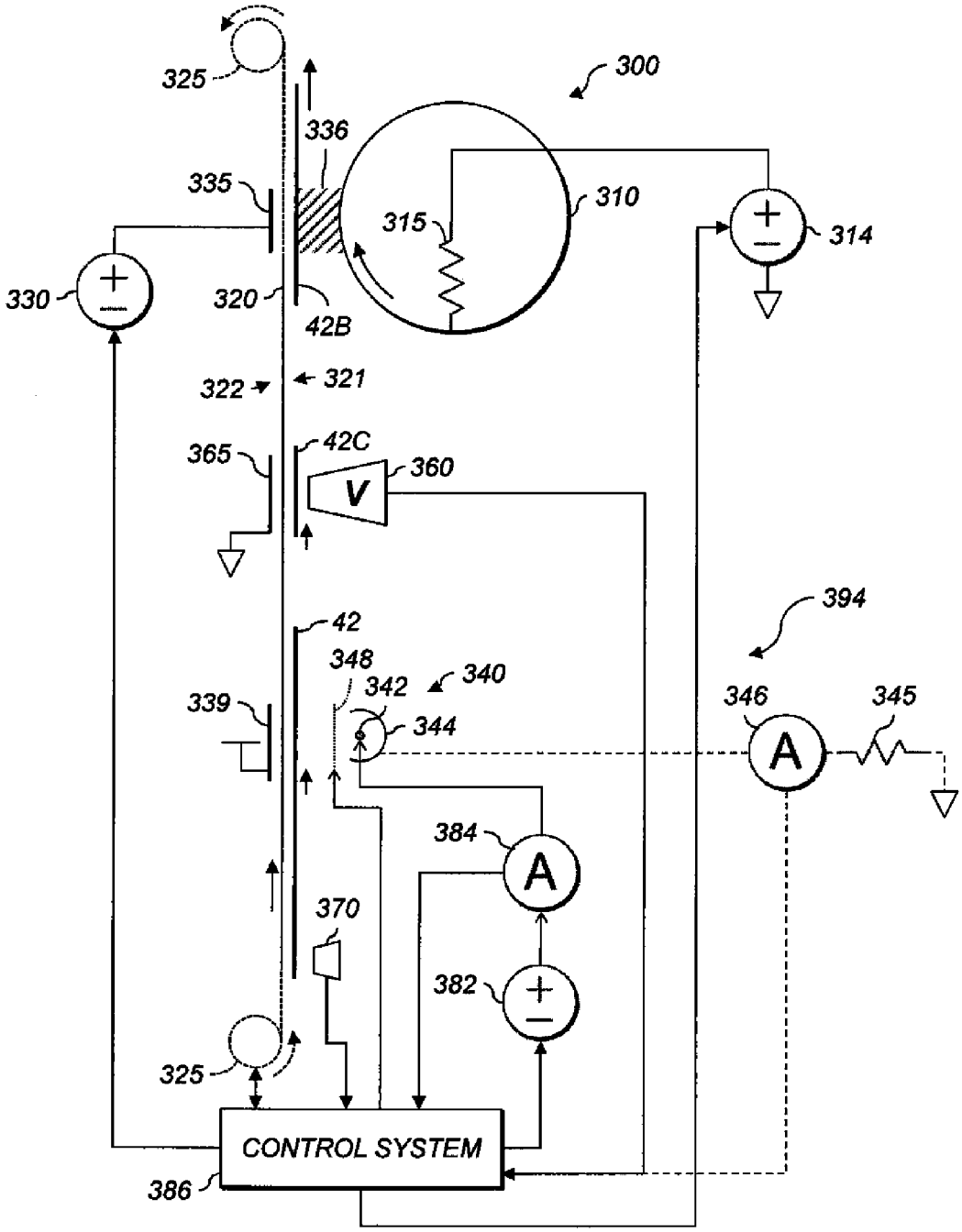
FIG. 3 shows a printing system according to various embodiments.

FIG. 3 shows a printing system according to various embodiments. The printing system includes rotatable transport member 320, which has obverse 321 and reverse 322. Transport member 320 transports a receiver (e.g., receiver 42, 42C, 42B) on obverse 321, i.e., disposed over or tacked down to obverse 321. Transport member 320 can be a roller or a belt. Belt transport members 320 can be entrained around rollers 325. Control system 386 drives transport member 320 at a selected speed (rotational velocity, or linear velocity of receiver 42 on obverse 321). Transport member 320 or one or more of the rollers 325 can include an encoder or other device for sensing the speed of transport member 320 or receiver 42 thereon. This is represented graphically in FIG. 3 by the double-headed arrow between bottom roller 325 and control system 386: system 386 provides drive information and the encoder on bottom roller 325 provides feedback. Control system 386 uses the feedback to maintain the desired speed.

Tackdown unit 394 includes electrode 339 which can be planar, arranged facing reverse 322 of transport member 320. Electrode 339 is held at a selected potential, e.g., ground or a bias voltage. A voltage source (not shown) can be connected to electrode 339 to hold it at the selected potential. Source 382, in response to control system 386, produces a tackdown current. In the example shown, source 382 is a voltage source; it can also be a current source. Meter 384 measures a respective resulting charger current or voltage corresponding to the tackdown current. In the example shown, meter 384 is an ammeter in series with source 382; if source 382 is a current source, meter 384 is a voltmeter, e.g., measuring the voltage on corona wire 342. Source 382 can produce a constant tackdown current. The tackdown current is the current from corona wire 342 to receiver 42. The tackdown current is equal (neglecting parasitics) to the difference between the current into corona wire 342, measured by meter 384, and the current out of shell 344 (discussed below), measured by meter 346. Resistor 345 is optional but meter 346 is not. The wires between shell 344, meter 346, resistor 345, and control system 386 are shown dashed solely to differentiate them from other wires. Control system 386 is responsive to the measured current from meter 346. In various embodiments, corona wire 342 extends across the receiver in the cross-track direction, so the tackdown current integrates over small-scale nonuniformities in the cross-track direction. The current out of source 382 is not necessarily constant, even when the tackdown current is constant.

Charger 340 is responsive to the tackdown current. Charger 340 is spaced apart from transport member 320 and receiver 42 by a gap. Charger 340 selectively deposits charge on receiver 42 on obverse 321. In the example shown, charger 340 includes a corona charger including corona wire 342 partly surrounded by shell 344, which is at least partly conductive. Optional resistor 345 connects shell 344 to ground (or another selected voltage). High voltage of a given polarity applied to corona wire 342 causes charge of the same polarity to be showered onto the surface of receiver 42. Some charge also strikes shell 344, as discussed below. Resistor 345 is optional and can be used to increase output of the charger. If resistor 345 is not used, meter 346 still measures current collected by shell 344. In some embodiments, a bias applied to grid 348 by control system 386 or components responsive thereto (not shown) controls the amount of charge reaching receiver 42. In some embodiments, charger 340 includes a static string or pin charger.

Non-contact voltmeter 360 is arranged facing receiver 42C on obverse 321 after charger 340. Voltmeter 360 can be a TREK model 344 or similar. In various embodiments, voltmeter 360 can measure up to a ±3 kV range of sensed voltages. In various embodiments, voltmeter 360 is maintained at a selected spacing from the surface of transport member 320. The spacing can be adjusted to broaden the range of thicknesses of receiver 42C that can be measured by voltmeter 360. In various embodiments, ground electrode 365, which can be planar, is disposed facing reverse 322 opposite voltmeter 360.

Control system 386 controls tackdown unit 394 and voltmeter 360. Control system 386 can include a processor, FPGA, PLD, PAL, PLA, or other logic or processing unit. The functions of control system 386 will be discussed further below. Control system 386 can include or be associated with components it controls and responds to. Control system 386 can be part of or separate from LCU 99 (FIG. 1).

Control system 386 drives a selected voltage or current through charger 340, e.g., using source 382, and measures a resulting voltage using non-contact voltmeter 360. Using the selected voltage or current and the measured resulting voltage, control system 386 automatically estimates a capacitance of the receiver. For example, control system 386 drives receiver 42 at selected speed S (m/s), optionally with encoder feedback as discussed above. Corona wire 342 extends a certain length L in the cross-track direction. Using constant-current source 382, control system 386 drives a selected current I through corona wire 342, and using voltmeter 360, control system 386 measures the resulting voltage V. For a receiver of width X in the cross-track direction, X<L, the fraction of current I deposited on receiver 42A is W/L. The charge per unit area Q/A on receiver 42 and transport member 320 in series is thus $$Q/A=I\times(X/L)/(S\times L)$$

$$[C/s\times(m/m)\times(m/s\times m)^{-1}=C/m^2].$$

A capacitor has Q/A=(C/A)×V, or C/A=(Q/A)/V. The controller uses this equation to estimate the capacitance per unit area C/A of the series combination of the capacitances of receiver 42 and transport member 320. The controller then removes the known capacitance of transport member 320 to produce an estimate of the capacitance of receiver 42. For total capacitance per unit area C/A, receiver capacitance per unit area $C_{42}/A$, and transport-member capacitance per unit area $C_{320}/A$, $$A/C=A/C_{42}+A/C_{320},$$

so $$C_{42}=A(A/C-A/C_{320})^{-1}.$$

Each estimate is accurate within tolerances and contributions from parasitics. Control system 386 then causes power source 314 to produce an electric transfer field that transfers toner and compensates for the estimated variation. This can be performed to compensate in real time for variations. In various embodiments, the estimate of receiver capacitance per unit area is accurate within ±20%.

In various embodiments, the printing system includes transfer unit 300. Transfer unit 300 includes rotatable static-dissipative member 310 connected to transfer power source 314, optionally through resistance 315, e.g., a fixed resistor. Static-dissipative member 310 can be a roller or a belt. In various embodiments, static-dissipative member 310 has a core and one or more coverings, which can be static-dissipative coverings. "Static-dissipative" means that the volume resistivity of the covering(s) falls in the range of $10^6$ to $10^{12}$ Ω-cm or the surface resistance of the covering(s) falls in the range of $10^7$ to $10^{13}$Ω/□. Static-dissipative member 310 is adapted to transfer toner to receiver 42B on obverse 321.

In various embodiments, power sources 314, 330 are responsive to control system 386 and selectively produce an electrostatic transfer field. For example, transfer power source 314 can produce the electrostatic transfer field between static-dissipative member 310 and backing electrode 335. The field extends between static-dissipative member 310 and backing electrode 335, which is disposed opposite transport member 320 from static-dissipative member 310.

In these embodiments, control system 386 causes transfer power source 314 (and, optionally, 330) to produce the electrostatic transfer field at a strength (e.g., in V/m) corresponding to the estimated capacitance. The capacitance and field strength can be positively or negatively correlated.

In an example, control system 386 is adapted to cause transfer power source 314 to produce a higher transfer bias, i.e., a larger-magnitude voltage difference between the electrodes for a smaller estimated capacitance than for a larger estimated capacitance, in order to maintain the desired electrostatic transfer field. This is because the capacitance of the paper is in series with the capacitance of the air gap. In series strings of capacitors, capacitors with smaller values experience higher voltage drops ($Q=C_1V_1=C_2V_2$, so $C_1>C_2$ implies $V_1<V_2$). Toner is transferred by a desired field across the air capacitor between receiver 42A and static-dissipative member 310, so the large voltage drop across a small receiver capacitance is compensated for by increasing the voltage across the series string to obtain a desired magnitude of voltage across transfer zone 336. In various examples, the receiver capacitance per unit area is lower for thicker receivers 42 than for thinner receivers, since receiver 42 is behaving as a parallel-plate capacitor, in which capacitance is inversely proportional to thickness.

Electrode 335 can be a roller, e.g., a paper transfer roller (PTR); it can also be a belt, plate, line, or other member in sliding contact with transport member 320. Electrode 335 can also be a conductive layer beneath a photoconductive layer. In various embodiments, backing electrode 335 is biased by power source 330. In various embodiments, power source 330 can be grounded. In various embodiments, power sources 314, 330 can be set to respective voltages to pull toner off of static-dissipative member 310. For example, for a negatively charger toner, a more positive voltage can be applied by power source 330 than applied by power source 314. In various embodiments, transfer power source 314 can produce a selected voltage or a selected current between static-dissipative member 310 and backing electrode 335.

The electrostatic transfer field produced by power sources 314 or 330 causes toner to be transferred between static-dissipative member 310 and receiver 42B in transfer zone 336. Other substances capable of holding electrostatic charge when in particulate form can also be transferred. As used herein, the term "toner" includes such substances. In an example, power source 314 applies a voltage bias to a core (not shown) of member 310. That is, power sources 314 or 330 (or both) produce a selected voltage difference between static-dissipative member 310 and receiver 42B or electrode 335. This is similar to power source 240 and transfer backup member 113 (both FIG. 2). Power source 330 can also be a current supply. In various embodiments, power source 314 or 330 can apply voltage or current directly to electrode 335, or to static-dissipative member 310, or to both. In various embodiments, power source 314 or 330 produces a selected current between static-dissipative member 310 and electrode 335.

In another embodiment, static-dissipative member 310 is a blanket cylinder, e.g., transfer member 112, FIG. 2. Toner is transferred from static-dissipative member 310 to receiver 42B (also shown in FIG. 2). In this embodiment, member 310 includes a metal core. A compliant, 10 mm thick, elastomeric static-dissipative covering such as a polyurethane containing an antistatic agent is disposed over the metal core, and a relatively non-compliant, thin (6 μm) static-dissipative release layer such as a ceramer is applied over the elastomeric covering. Examples of such a multi-layered static-dissipative member are given in U.S. Pat. No. 5,948,585. Receiver 42A can be supported by a backup belt (e.g., as shown in FIG. 2) or roller.

In various embodiments, moisture sensor 370 is operative to detect a moisture content of receiver 42. Moisture sensor 370 can be placed at various points along the paper path. Moisture sensor 370 can be a capacitive or infrared sensor. For example, in an infrared sensor, receiver 42 is illuminated with near-IR light preferentially absorbed by O—H bonds. The moisture of the paper is inversely related to the amount of the near-IR light reflected. Control system 386 is further adapted to identify a type or physical thickness of the receiver using the estimated capacitance and the detected moisture content. For example, the effective dielectric thickness of bond paper decreases as its moisture content increases, since water provides conductive paths into the body of the sheet. Consequently, if the moisture content of receiver 42 exceeds a selected threshold indicating receiver 42 is paper (is capable of absorbing moisture), control system 386 can estimate the physical thickness of receiver 42 using the estimated dielectric thickness and the measured moisture content. If receiver 42 has a higher moisture content then it will have a higher capacitance than it would if it had a lower moisture content. This will cause the dielectric thickness to be lower than the physical thickness. Therefore, control system 386 can estimate the physical thickness of the receiver to be the dielectric thickness modified using the measured moisture content. For example, the dielectric thickness can be modified by adding or multiplying by a factor proportional to the measured moisture content. In various embodiments, control system 386 sets transfer bias using dielectric thickness but not physical thickness.

In another example, a very low moisture content, e.g., <50% of the expected moisture content of bond paper brought to equilibrium in a 50% RH environment, can indicate the paper is synthetic, e.g., a transparency or other insulator. In this example, capacitance is related to receiver thickness but not to receiver moisture content. In this example, control system 386 does not adjust the estimate of receiver thickness it produces using the receiver capacitance per unit area. Further details about paper moisture content are found in commonly-assigned, copending U.S. Ser. No. 13/245,931 by Tombs et al., filed Sep. 27, 2011, which is incorporated herein by reference.

In yet another example, a high capacitance reading with a high moisture content reading and a low capacitance reading with a low moisture content reading can both be determined to be paper instead of insulator.

In various embodiments, control system 386 adjusts exposure parameters, e.g., Dmax, or fixing parameters, e.g., whether to gloss, or the fixing temperature, based on the identified receiver type. Exposure parameters include those relating to exposure subsystem 220 (FIG. 2), and fixing parameters include those relating to fuser 60 (FIG. 1).

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

PARTS LIST

31, 32, 33, 34, 35 printing module
38 print image
39 fused image
40 supply unit
42, 42A, 42B, 42C receiver
50 transfer subsystem
60 fuser
62 fusing roller
64 pressure roller
66 fusing nip
68 release fluid application substation
69 output tray
70 finisher
81 transport web
86 cleaning station
99 logic and control unit (LCU)
100 printer
111 imaging member
112 transfer member
113 transfer backup member
201 transfer nip
202 second transfer nip
206 photoreceptor
210 charging subsystem
211 meter
212 meter
213 grid
216 surface
220 exposure subsystem
225 development station
226 toning shell
227 magnetic core
230 developer supply
234 developer
236 toning zone
240, 245 power source
300 transfer unit
310 static-dissipative member
314 power source

315 resistance
320 transport member
321 obverse
322 reverse
325 rollers
330 power source
335 electrode
336 transfer zone
339 electrode
340 charger
342 corona wire
344 shell
345 resistor
346 current meter
348 grid
360 voltmeter
365 ground electrode
370 moisture sensor
382 source
384 meter
386 control system
394 tackdown unit
S slow-scan direction

The invention claimed is:

1. A printing system, comprising:

a) a rotatable transport member having an obverse and a reverse and adapted to transport a receiver on its obverse;

b) a tackdown unit that includes:

i) an electrode arranged facing the reverse of the transport member;

ii) a source for selectively producing a tackdown current;

iii) a charger spaced apart from the transport member facing the obverse thereof, the charger adapted to selectively deposit charge on a receiver on the obverse in response to the tackdown current; and iv) a non-contact voltmeter arranged facing the receiver on the obverse after the charger; and c) a control system adapted to:

i) drive a selected voltage or current through the charger using the source and measure a resulting voltage using the non-contact voltmeter; and ii) using the selected voltage or current and the measured resulting voltage, automatically estimate a capacitance of the receiver.

2. The printing system according to claim 1, further including:

d) a transfer unit that includes:

i) a rotatable static-dissipative member adapted to transfer toner to the receiver on the obverse; and ii) a transfer power source responsive to the control system for selectively producing an electrostatic transfer field between the static-dissipative member and the receiver, so that toner is transferred from the static-dissipative member to the receiver; wherein e) the control system is further adapted to cause the transfer power source to produce the electrostatic transfer field at a strength corresponding to the estimated capacitance.

3. The printing system according to claim 2, wherein the static-dissipative member is a blanket cylinder and toner is transferred from the static-dissipative member to the receiver.

4. The printing system according to claim 3, wherein the transfer power source produces a selected voltage between the static-dissipative member and a backing electrode.

5. The printing system according to claim 3, wherein the transfer power source produces a selected current between the static-dissipative member and a backing electrode.

6. The printing system according to claim 2, further including a backing electrode opposite the transport member from the static-dissipative member, wherein the transfer power source produces the electrostatic transfer field between the static-dissipative member and the backing electrode.

7. The printing system according to claim 1, wherein the charger includes a corona charger, a static string, or a pin charger.

8. The printing system according to claim 2, wherein the static-dissipative member is a roller or a belt.

9. The printing system according to claim 2, wherein the control system is adapted to cause the power source to produce a higher transfer bias for a smaller estimated capacitance than for a larger estimated capacitance.

10. The printing system according to claim 1, wherein the transport member is a roller or a belt.

11. The printing system according to claim 1, further including ground electrode facing the reverse.

12. The printing system according to claim 1, wherein the voltmeter can measure up to a ±3 kV range of sensed voltages.

13. The printing system according to claim 1, further including a moisture sensor operative to detect a moisture content of the receiver, wherein the control system is further adapted to identify a type of the receiver using the estimated capacitance and the detected moisture content.

14. The printing system according to claim 13, wherein the control system is further adapted to adjust exposure or fixing parameters based on the identified receiver type.

* * * * *